US006997335B2

(12) United States Patent
Irwin

(10) Patent No.: US 6,997,335 B2
(45) Date of Patent: Feb. 14, 2006

(54) INTEGRAL SHELF ORGANIZER AND BROCHURE DISPENSER

(76) Inventor: Klee Irwin, 5310 Beethoven St., Los Angeles, CA (US) 90066

( * ) Notice: Subject to any disclaimer, the term of this patent is extended or adjusted under 35 U.S.C. 154(b) by 0 days.

(21) Appl. No.: 10/157,600

(22) Filed: May 30, 2002

(65) Prior Publication Data

US 2003/0222039 A1 Dec. 4, 2003

(51) Int. Cl.
*A47F 5/08* (2006.01)

(52) U.S. Cl. ..... 211/90.01; 211/10; 211/126.1; 211/50

(58) Field of Classification Search ..... 211/90.01, 211/50, 119.003, 59.3, 52, 51, 10, 11, 126.1, 211/126.13, 133.6; 248/126
See application file for complete search history.

(56) References Cited

U.S. PATENT DOCUMENTS

D56,992 S * 1/1921 Robert ..... D6/476
2,884,139 A * 4/1959 Dunham ..... 211/184
2,912,113 A * 11/1959 Durec ..... 211/51
D242,009 S * 10/1976 Hemingway ..... D6/473
D256,644 S * 9/1980 Marks ..... D6/476
4,600,119 A * 7/1986 Olson ..... 221/75
D328,539 S * 8/1992 Waterston ..... D6/475
D332,347 S * 1/1993 Raadt et al. ..... D3/20
5,657,880 A * 8/1997 Birnbaum ..... 211/50
5,833,334 A * 11/1998 Harper ..... D6/476
D402,483 S * 12/1998 Alvarez et al. ..... D6/408
5,862,980 A * 1/1999 Samuelson ..... 211/50

* cited by examiner

*Primary Examiner*—Jennifer E. Novosad
(74) *Attorney, Agent, or Firm*—Thomas W. Cook

(57) ABSTRACT

A point-of-sale shelf organizer for product containers which includes a product container organizer; and, an integral literature dispensing chamber. In one of the embodiments of this invention, the front of the organizer includes a mini bill-board extension for display of graphics and/or a promotional message. This organizer is preferably formed from transparent thermoplastic materials so as to permit visual access to the items of promotional literature and graphics that are retained therein.

3 Claims, 1 Drawing Sheet

10
14
28
18
20
16'
16
24
26
12

16'
20
18
16
26
22
20
24

INTEGRAL SHELF ORGANIZER AND BROCHURE DISPENSER

BACKGROUND OF THE INVENTION

1. Field of the Invention

This invention relates to an article of manufacture. More specifically, this invention is directed to an integral shelf organizer and brochure dispenser for merchandizing of unique or distinctive products.

2. Background of Invention

The use of shelf organizers and brochure dispensers for the vending of distinctive products is a common practice in the merchandizing of patent medicines, vitamins and dietary supplements. Oftentimes a store will offer its customers choices of similar products from different suppliers. In order to assist the customer in his selection process, some suppliers include in their displays, pamphlets and like, to highlight the distinctive features and advantages of their product over a competing product. More recently, this practice has taken the form of physically affixing such literature to the product container. This is generally accomplished by providing literature with a punch-out or hole that permits it to be attached/fitted to the neck of the container.

Obviously, the ready availability of such informational materials is both desirable and helpful to assist the consumer in product differentiation, and in the selection process. Notwithstanding the desirability of this practice, the merchant has only limited space to both display the products offered by his establishment, and provide informational brochures supplied by the product manufacturer. Because of the foregoing practical limitation on shelf and counter space in the retail environment, many informational brochures remain unavailable to independent customer review unless specifically requested by the customer from the retail merchant. Accordingly, important consumer information may be inadvertently withheld from a prospective customer at the time of his formulation of his purchasing decision. Such information may be particularly significant where the customer is hypersensitive to a component of the product, or is taking a medication that may interact or become inactive in the presence of a product that is independently selected by the consumer.

Thus, it is imperative to provide information, beyond that contained upon the product container or label, to afford the prospective purchaser with the ability to both make an informed selection as to a specific supplier's product from among competing products; and, to alert him to potential adverse interaction or reaction with another supplement or medication. Up to now, the supplier's interest and desire to comply with these dual objectives has been totally dependent upon the merchant's cooperation and the hope/belief that the potential customer has sufficient information to make an informed purchasing decision. This objective needs to be accomplished, of course, within the retailer's limited space and preferably without additional added cost to the retailer. Up to now, the retailer's limitations continue to dictate how the foregoing objectives are met (if at all).

OBJECTS OF THE INVENTION

It is the object of this invention to remedy the above as well as related deficiencies in the prior art.

More specifically, it is the principal object of this invention to provide an integral shelf organizer and product literature dispenser for a point-of-sale retail environment.

It is another object of this invention to provide an integral shelf organizer and product literature dispenser wherein the literature dispenser occupies essentially the same footprint on the merchant's shelf as the shelf organizer.

It is yet another object of this invention to provide an integral shelf organizer and product literature dispenser wherein the literature dispenser includes an mini bill-board for inclusion of a product specific logo or brand name signature.

Additional objects of this invention include an improved method of merchandizing products with the integral shelf organizer and product literature dispenser of this invention.

SUMMARY OF THE INVENTION

The above and related objects of this invention are achieved by provision of a unitary device in the form of a point-of-sale shelf organizer for a product container wherein the organizer comprises an upper and lower planar element fixed in parallel, and in spaced apart relation to one another, by a pair of lateral supporting side-walls and a back-wall. The resulting structure fabricated in this manner includes an interior storage cavity or chamber and an exterior open channel, integral with the interior storage cavity or chamber. The exterior open channel is defined by a planar surface that is common to an interior storage cavity, and by each of the side walls and back wall that defines the interior storage cavity. Each of these lateral sidewalls and back wall extend upward and above the upper planar surface of the chamber to from a rail or retaining element so as to define the lateral boundary limits of the open channel that is supported upon this upper planar element.

In the preferred embodiments of this invention, the integral device of this invention is further enhanced by the forward extension of the lower planar element beyond the literature storage/dispensing chamber. This forward extension is preferably modified by forming or bending the forward portion of the extension to form an opposing lip on the rear surface of the extension, so as to provide means for retaining a product specific logo or brand name signature on this forward extension.

In another of the preferred embodiments of this invention, the back-wall support of the literature storage/dispensing chamber is angled forward from the bottom to the top thereof to provide for mechanical "feathering" of the individual items of literature within this chamber and thus ease of removal of single piece thereof from the open end of the chamber.

DETAILED DESCRIPTION OF THE INVENTION INCLUDING PREFERRED EMBODIMENTS

Figures 1, 2:
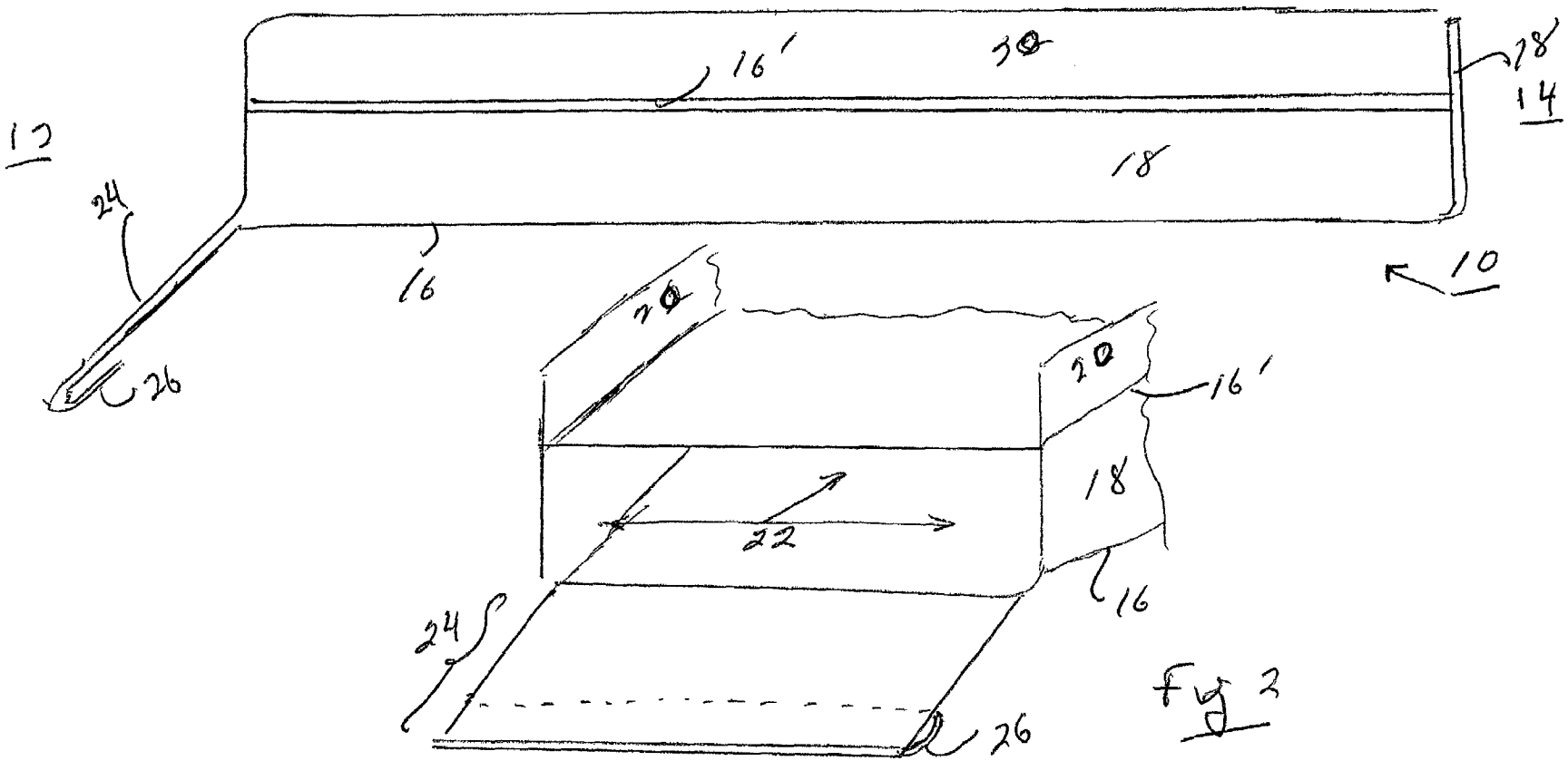
FIG. 1 is a perspective view of integral shelf organizer and literature dispenser of this invention.
FIG. 2 is an end-on view of the integral device of FIG. 1 when viewed from the front.

The Figures which accompany this application, and referenced herein, depict a representative embodiment of the integral shelf organizer and literature dispenser of this invention. In the embodiments of this invention illustrated in these Figures, one or more components of the integral device may appear in more than one Figure. Accordingly, components which are common to more than one Figure are assigned a common reference numeral for continuity of description and ease of understanding.

The preferred embodiment of this invention is illustrated in FIG. 1. This Figure depicts a side view of the integral device (10) without either literature or product containers. In this Figure, the forward or front (12) of the integral device (10) is on the left-hand side of the Figure, and the rear or back (14) of the integral device (10) is on the right-hand side of the Figure. As shown therein, the integral device (10) comprises two planar elements (16, 16') arranged parallel to one another. These planar elements (16, 16') are supported on each of their respective sides and in the rear by a wall or panel (18) that is molded into or separately joined to one or both of the parallel planar elements (16, 16'). In the embodiments of the invention depicted in this Figure, each of the side and back wall elements (18) extend above the upper planar element (16') to define a retaining element (20) corresponding to a shelf footprint of the integral device (10). Thus, product containers can be placed upon this upper planar element (16') of the integral device (10) and are retained within the defined footprint of the integral device (10) on the merchant's shelf.

FIG. 2 shows the integral device (10) when viewed from the front (12). As more fully visible from this perspective, each of the planar surfaces (16, 16') of the integral device (10) define an elongate chamber or cavity (22). The width of the cavity (22) is generally dictated by the dimensions of the product container which is supported on the upper planar surface (16'). Similarly, the length of the cavity is generally dictated by some accepted standard provided by the retailer, or arbitrarily determined by the dimensions of the number of containers to be placed upon this surface. In any event, the extension of each of the side-walls (18) forms a retaining element (20) to maintain the product container on the integral device (10).

As above noted, the lower planar element (16) is preferably extended and angled downward to form a mini bill-board (24). This mini bill-board (24) is preferably molded or formed to provide an opposing lip (26) that is in pressure contact with the backside of the forward extension of the planar element (16). The opposing lip (26) is designed to retain a piece of artwork or graphics on the mini bill-board (24) which identifies the product or sets it apart from the competitors' products, and thereby assists the customer to locate a specific product on the retailer's shelf.

Additional embodiments of this invention include the further modification of the integral device by use of color thermoplastic resins to further enhance visibility and distinctiveness on the retailer shelf; and, inclusion of other attention getting devices (blinking LED's, etc.) to attract customer attention.

The invention, as above described, in provided as illustrative of a number of the preferred embodiments of this invention. This description is neither intended, nor should it be construed to delineate the scope of this invention, which has been reserved for the claims that follow.

What is claimed is:

1. A apparatus for point-of-sale display of product and dispensing literature comprising:

a chamber for dispensing literature comprising an elongate, substantially uniform, cavity, with an opening, the cavity formed by an upper planar element, a lower planar element, a first side-wall, a second side-wall, and a back-wall, the upper planar element and the lower planar element maintained in substantially parallel relation to one another by the first side-wall and the second side-wall;

the back-wall extending from the upper planar element to the lower planar element;

an open channel for retaining product, the open channel having a product supporting surface defined by the upper planar element of the literature dispensing chamber, the open channel having a rail formed by an extension of the first side-wall above the upper planar element, an extension of the second side-wall above the upper planar element, and an extension of the back-wall above the upper planar element and the channel being open at its front end, opposite the extension of the back wall;

the lower planar element extends forward and downward from the literature dispensing chamber to form a mini bill-board for display of information; and the forward portion of the extension of the lower planar element is formed to create an opposing lip, to provide means for retaining product specific information.

2. The apparatus of claim 1, wherein the back-wall of the literature dispensing chamber is slanted forward into the cavity between the upper planer element and the lower planar element, to provide a means for mechanical "feathering" of literature placed within the cavity.

3. The apparatus of claim 1 wherein the mini bill-board is formed of thermoplastic resin to enhance visibility of product specific information associated with the mini bill-board.

* * * * *